US012421712B2

(12) United States Patent
Goodman

(10) Patent No.: US 12,421,712 B2
(45) Date of Patent: Sep. 23, 2025

(54) CONNECTORS FOR A FRAMING SYSTEM

(71) Applicant: David H. Goodman, Austin, TX (US)

(72) Inventor: David H. Goodman, Austin, TX (US)

( * ) Notice: Subject to any disclaimer, the term of this patent is extended or adjusted under 35 U.S.C. 154(b) by 506 days.

(21) Appl. No.: 17/900,987

(22) Filed: Sep. 1, 2022

(65) Prior Publication Data

US 2023/0103559 A1 Apr. 6, 2023

Related U.S. Application Data

(60) Provisional application No. 63/252,824, filed on Oct. 6, 2021.

(51) Int. Cl.
*E04B 1/19* (2006.01)

(52) U.S. Cl.
CPC .... *E04B 1/1903* (2013.01); *E04B 2001/1993* (2013.01)

(58) Field of Classification Search
CPC ..... E04B 1/1903; E04B 1/1912; E04B 2001/1915; E04B 2001/2406; E04B 2001/1963; E04B 2001/1957; E04B 2001/2448; E04B 2001/5881; E04B 2/76; Y10T 403/34; Y10T 403/342; Y10T 403/344; Y10T 403/345; Y10T 403/346; Y10T 403/347; Y10T 403/348; Y10T 403/349
See application file for complete search history.

(56) References Cited

U.S. PATENT DOCUMENTS

| | | | | | |
|---|---|---|---|---|---|
| 3,765,541 | A * | 10/1973 | Madey | A47B 47/00 D6/702 |
| 4,449,843 | A * | 5/1984 | Wendel | E04B 1/1903 52/81.3 |
| 4,534,672 | A * | 8/1985 | Christian, III | E04B 1/1903 403/126 |
| 4,904,108 | A * | 2/1990 | Wendel | E04B 1/1912 403/356 |
| 4,922,669 | A * | 5/1990 | De Pas | E04B 1/1903 403/171 |
| 5,372,447 | A * | 12/1994 | Chung | E04B 1/585 403/177 |
| 9,932,734 | B1 * | 4/2018 | Winter | E04B 1/1903 |
| 10,174,498 | B2 * | 1/2019 | Winter | E04B 1/388 |
| 10,508,005 | B2 * | 12/2019 | Spronken | E04B 1/19 |
| 2017/0268224 | A1 * | 9/2017 | Sato | E04H 4/148 |
| 2022/0127900 | A1 * | 4/2022 | Briese | F16B 7/042 |

FOREIGN PATENT DOCUMENTS

| | | | | |
|---|---|---|---|---|
| DE | 3610686 | A1 * | 10/1987 | |
| DE | 3620379 | A1 * | 12/1987 | |
| DE | 19701442 | C1 * | 4/1998 | A47B 47/0016 |
| DE | 202015001209 | U1 * | 6/2015 | E04B 1/2403 |
| EP | 0736637 | A1 * | 10/1996 | |
| EP | 1253255 | A1 * | 10/2002 | A47B 47/005 |
| FR | 1380505 | A * | 12/1964 | |
| FR | 2331745 | A1 * | 6/1977 | |
| FR | 2590943 | A1 * | 6/1987 | |

* cited by examiner

*Primary Examiner* — Jonathan P Masinick
(74) *Attorney, Agent, or Firm* — Pierson IP, PLLC

(57) ABSTRACT

Connectors for a framing system, wherein each of the connectors includes pairs of flanges that extend in parallel away from a base.

9 Claims, 19 Drawing Sheets

CONNECTORS FOR A FRAMING SYSTEM

BACKGROUND INFORMATION

Field of the Disclosure

Examples of the present disclosure are related to systems and methods for connectors for a framing system. More specifically, embodiments are related to unitary connectors for a framing system, wherein each of the unitary connectors include pairs of flanges that extend in parallel away from a base.

Background

Framing is the fitting together of pieces to give structural support and shape. Framing systems can use a wide variety of materials. There are many different types of applications and styles of framing.

Slot framing utilizes straight sections of extruded bars to create custom building projects. The extruded bars have recessions that accept hardware for creating joints or mounting components like hinges, connects, support plates, etc. The profiles of the extrusions within the bars allow for movement of connectors within the recessions for optimum positioning while ensuring a secure fit without welding.

However, current connectors are typically only configured to be inserted into a single recession of an extruded bar. This requires multiple connectors or parts to be used when forming a corner of a frame. Furthermore, the multiple connectors or parts necessary to form a corner utilizing conventional methods creates multiple, and weaker stress points, at each connection.

Accordingly, needs exist for systems and methods for unitary connectors for a framing system, wherein each of the unitary connectors include multiple pairs of flanges that extend in parallel away from a base. Further, each of the pairs of flanges may be positioned at an angle orthogonal to other pairs of flanges, wherein a length of each of the flanges is longer than their width and a length of the base.

SUMMARY

Embodiments described herein disclose unitary connectors for a framing system. The unitary connectors may be formed of a single piece of extruded metal, and may be configured to form the boundaries of a framing system. In alternate embodiments, the connectors may be formed of a base that is configured to receive multiple extruded flanges. Each of the connectors may be configured to receive multiple pairs extruded bars, wherein each of the pairs extruded bars extend in different directions that are orthogonal to each other. Each of the connectors may include a base and at least two pairs of flanges.

The base may be a solid piece of metal, such as aluminum. In embodiments, the base may be square or rectangular cube in shape with rounded corners. The base may include a first face and a second face, wherein the first face and the second face are positioned orthogonal to each other. The base may also include pairs of receiving orifices on at least one face of the base. In embodiments, each of the faces of the baes may include a pair of receiving orifices. Each of the receiving orifices may be oblong, oval, etc. in shape and be configured to receive a proximal end of a flange.

Each of the pairs of flanges may include a first flange and a second flange. The first flange and the second flange may have first faces that are aligned with a face of the base and may have second faces that extend away from the face of the base. In embodiments, the length of each of the flanges may be longer that than a height, width, or length associated with the base. The length of each of the flanges may allow the flanges to be extended into extruded metal. In embodiments, a proximal end of each of the flanges may be extruded to have an oblong, oval, etc. shape. The proximal end of each of the flanges is configured to be press fitted into a corresponding receiving orifice to couple the flanges with the base. The shape of the flanges and the receiving orifices may be selected to increase the surface area between the two, which may add stability to the framing system. In embodiments, a length, height, and width of the proximal ends of the flanges may be shorter than the length, height, and width of the body of the flanges, wherein the length of the proximal ends of the flanges may be less than half of a width of the base.

The first flange and the second flange may be symmetrical flanges that extend in parallel away from the base. The first flange and the second flange may be mirrored images of each other about a plane positioned between the first flange and the second flange. By having multiple flanges extend away from the base in parallel with each other the connector may be coupled to upper and lower surfaces of extruded metal.

The first flange and the second flange may include an inner profile, outer profile, a first orifice, and a second orifice. The outer profile of the first flange and the second flange may have elevated projections with vertical sidewalls and a v-shaped indention, wherein the indention extends along a longitudinal axis of the corresponding flange. In embodiments, the v-shaped indention may be vertically offset from the proximal end of the flange.

The inner profile of the flanges may include a planer sidewall positioned between two tapered sidewalls.

The first orifices of the flanges may be configured to be aligned with each other, such that a coupling mechanism, screw, shaft, bolt, etc. may be inserted through both first orifices. Similarly, the second orifices of the flanges may be configured to be aligned with each other, such that a second coupling mechanism may be inserted through both second orifices.

In embodiments, the first pair of flanges and the second pair of flanges may be positioned 90 degrees or orthogonal to each other to have rotational symmetry, and be positioned on different faces of the base. This may assist in forming a corner, 90 degree angle, edge, boundary of a frame. In embodiments, the inner flanges of the pair of flanges may form a right angle along with the base. In other embodiments, the first pair of flanges and the second flanges may form a 180 degree connector.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
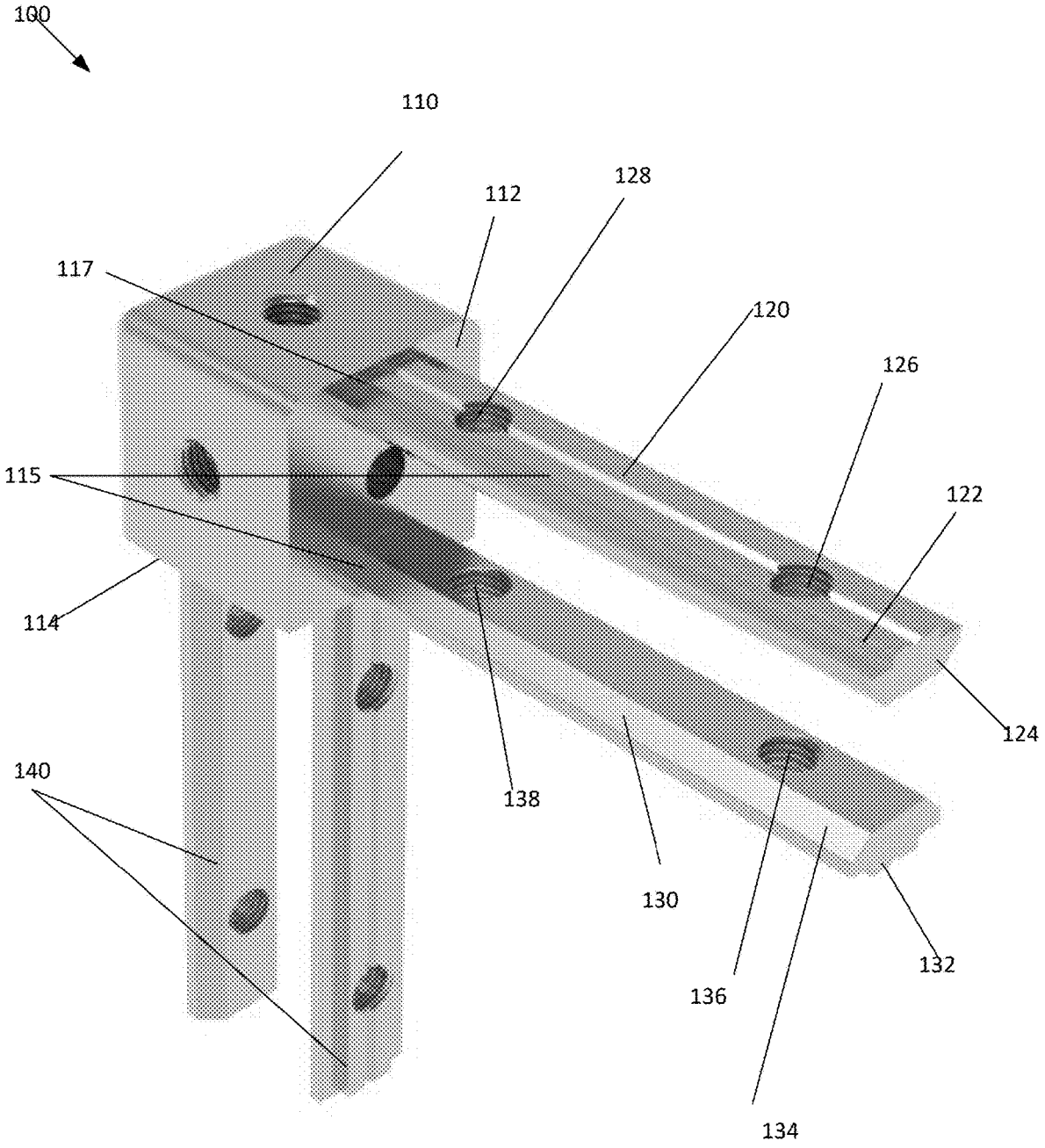
FIG. 1 depicts a connector for a framing system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts a connector 100 for a framing system, according to an embodiment. Connector 100 may be configured to receive a plurality of extruded bars with recesses to form an edge of a frame, platform, structure, etc. Connector 100 may be used with other connectors of various shapes and extruded bards to form the frame, platform, structure, etc. In embodiments, the connector 100 may be formed of a unitary piece by extruding metal, which may increase the rigidity of connector 100 while limiting the amount of stress points and complexity to form a connector 100. In other embodiments, connector 100 may be formed of a base 110 that is configured to receive flanges 115, 140, wherein flanges 115 140 are press fit into base 110. Connector 100 may include a base 110, a first pair of flanges 115, and a second pair of flanges 140.

Base 110 may be a solid piece of material, such as metal, plastics, etc. Base 110 may be square or rectangular in shape with rounded corners. The base 110 may include a first face 112 and a second face 114, wherein first face 112 and second face 114 are positioned orthogonal to each other. In embodiments, each of the faces 112, 114, etc. of base 110 may be planar faces. In other embodiments, first face 112 and second face 114 may not be positioned orthogonal to each other and may be positioned at any desired angle from each other. For example, first face 112 and second face 114 may be positioned on opposite faces of base 110.

First pair of flanges 115 and second pair of flanges 140 may be positioned on different faces of base 110. First pair of flanges 115 and second pair of flanges 140 may extend in directions that are orthogonal to each other. In other embodiments, first pair of flanges 115 and second pair of flanges 140 may extend in parallel to each other. This may enable each of the pairs of flanges 115, 140, etc. to receive different extruded bars to form the frame, platform, structure.

Each pair of flanges 115, 140 may include a first flange 120 and a second flange 130. First flange 120 and second flange 130 may be configured to extend away from a face of base 110 to a location remote from the face of base 110. In embodiments, the lengths of first flange 120 and second flange 130 may be substantially longer than a length, width, and height of base 110. This may enable substantial contact between the extruded bar (not shown) and first flange 120 and second flange 130. First flange 120 and second flange 130 may be symmetrical flanges, which are mirrored over a plane positioned between first flange 120 and second flange 130.

First flange 120 may include an inner profile 124, outer profile 122, first orifice 126, and second orifice 128. Inner profile 124 may include a planer sidewall positioned between two tapered sidewalls. Outer profile 122 may have elevated projections with vertical sidewalls and a v-shaped indention, wherein the indention extends along a longitudinal axis of the corresponding flange. In embodiments, outer profile 122 may be offset 117 from an edge of first face 112. This may allow the extruded bar to be positioned directly adjacent to first face 112. Additionally, this may allow the extruded bars to form the internal and external boundaries of the frame, without portions of connector 110 extended into an external surface of the frame.

Second flange 130 may include an inner profile 134, outer profile 132, first orifice 136, and second orifice 138. Inner profile 134 may include a planer sidewall positioned between two tapered sidewalls. Outer profile 132 may have elevated projections with vertical sidewalls and a v-shaped indention, wherein the indention extends along a longitudinal axis of the corresponding flange. In embodiments, outer profile 132 may be offset from an edge of first face 112. This may allow the extruded bar to be positioned directly adjacent to first face 112. In embodiments the outer profiles 122, 132 may face away from each other. This may increase the surface area of contact points between the flanges and the extruded bars away from the plane extending between flanges 120, 130, which may enable the flanges 120, 130 to be more susceptible to bend inward rather than outward.

First orifices 126, 136 may be configured to be aligned with each other, such that coupling mechanisms, screws, shafts, bolt, etc. may be inserted through both first orifices 126, 136, which may couple the extruded bar to the flanges at opposite locations. Similarly, the second orifices 128, 138 of the flanges may be configured to be aligned with each other, such that a second coupling mechanism may be inserted through both second orifices 128, 138. In embodiments, a first distance from first face 112 to first orifice 126 may be smaller than a second distance from first orifice 126 to second orifice 128. This may decrease the amount of forces applied between the flanges 120, 130 and base 110.

Figure 2:
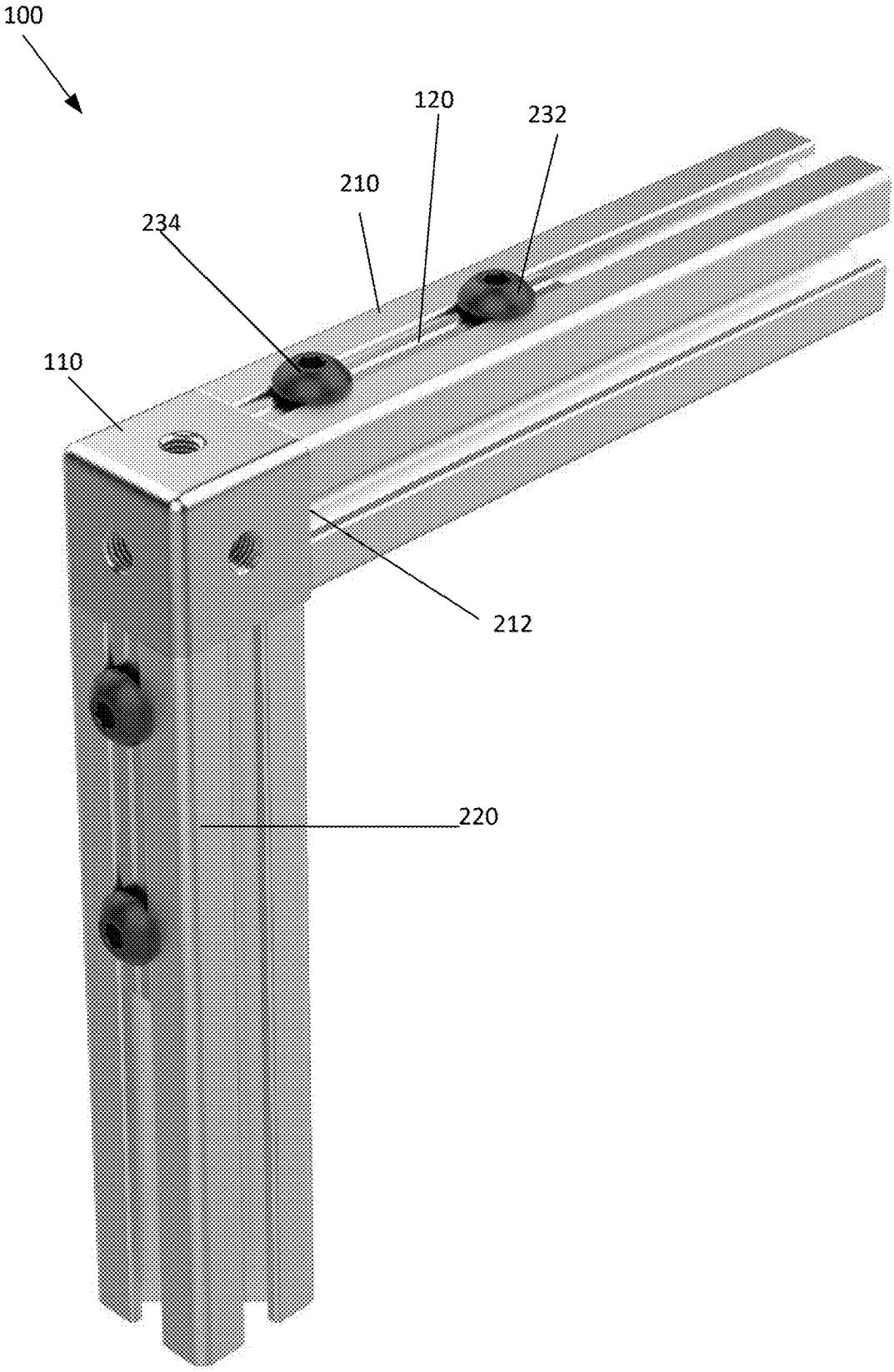
FIG. 2 depicts a connector coupled with extruded bars, wherein the extruded bars are positioned orthogonal to each other, according to another.

FIG. 2 depicts an embodiment of connector 100 coupled with extruded bars 210, 220, wherein extruded bars 210 and 220 are positioned orthogonal to each other. Elements depicted in FIG. 2 may be described above, and for the sake of brevity a further description of these elements may be omitted.

As depicted in FIG. 2, a first extruded bar 210 may be configured to be inserted into first pair 115 of flanges, and a second extruded bar 220 may be configured to be inserted into second pair 140 of flanges. These extruded bars 210, 220 may form a corner of the frame. In embodiments, a length and width of the extruded bars may be greater than that of the flanges 115, 140, which may enable the extruded bars 210, 220 to encompass the flanges 115, 140.

Furthermore, coupling mechanisms 232, 234 may be configured to be inserted into orifices 126, 128, respectively. This may limit the lateral movement of extruded bar 210. After inserting the coupling mechanisms 232, 234 through the orifices 126, 128, the coupling mechanisms 232, 234 may apply compressive forces towards the plane between the pairs of flanges.

Figure 3:
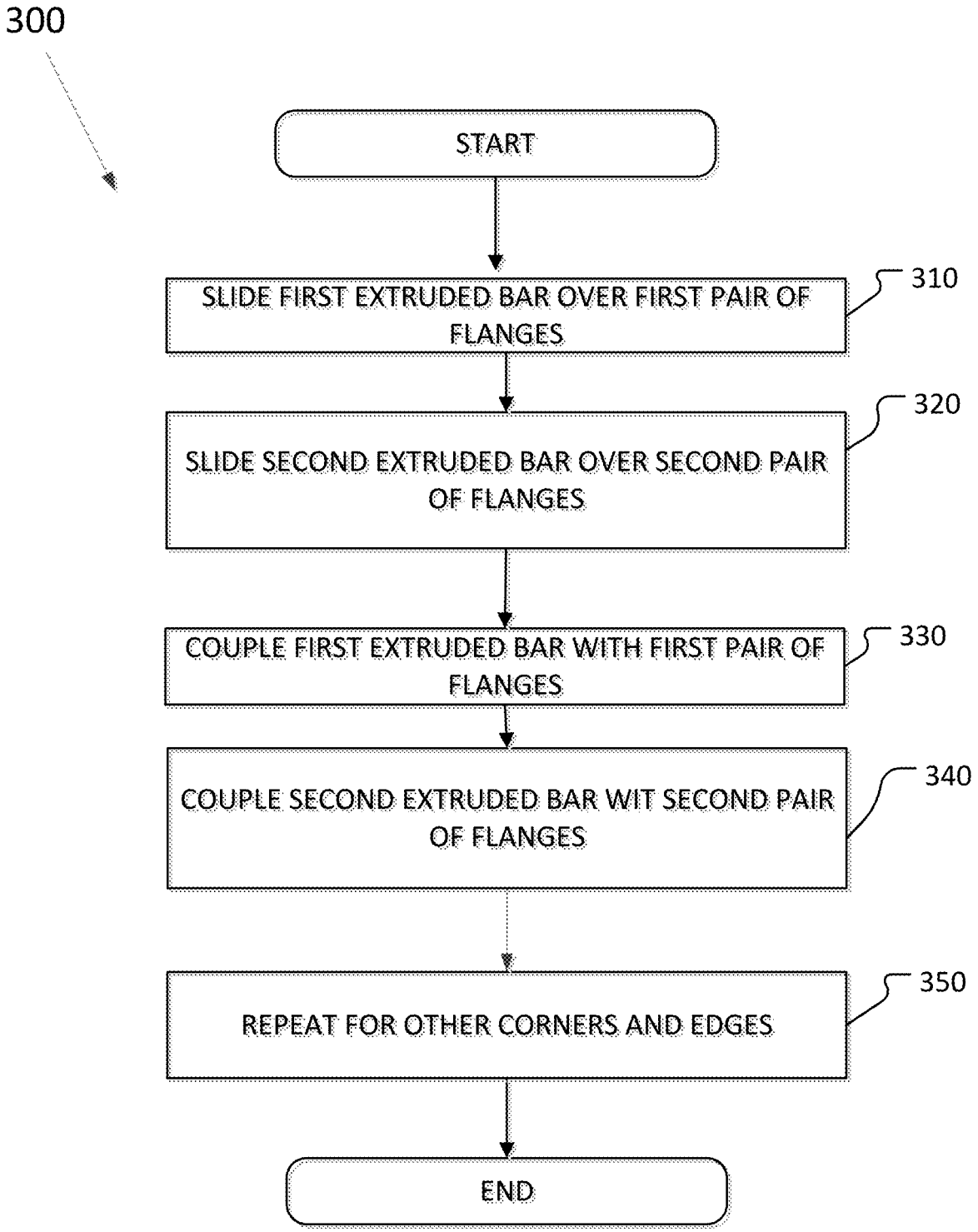
FIG. 3 depicts a method of utilizing connectors to form a frame, according to an embodiment.

FIG. 3 depicts a method 300 of utilizing connectors to form a frame, according to an embodiment. The operations of the method depicted in FIG. 3 are intended to be illustrative. In some embodiments, the method may be accomplished with one or more additional operations not described, and/or without one or more of the operations discussed. Additionally, the order in which the operations of the method are illustrated in FIG. 3 and described below is not intended to be limiting. Elements depicted in FIG. 3 may be described above. For the sake of brevity, a further description of these elements is omitted.

At operation 310, a first extruded bar may be positioned over a first pair of flanges, wherein the first extruded bar may be positioned flush against a first face of a base of the connector.

At operation 320, a second extruded bar may be positioned over a second pair of flanges, wherein the second extruded bar may be positioned flush against a second face of the base of the connector. In embodiments, the first face and the second face of the base may be positioned in planes that are orthogonal to each other.

At operation 330, the first extruded bar may be coupled with the first pair of flanges via screws of other coupling mechanisms.

At operation 340, the second extruded bar may be coupled with the second pair of flanges via screws of other coupling mechanisms. In embodiments, the second pair of flanges may extend from a different face of the base than the first pair of flanges.

At operation 350, these steps may be repeated for other corners and edges to form a frame.

Figure 4:
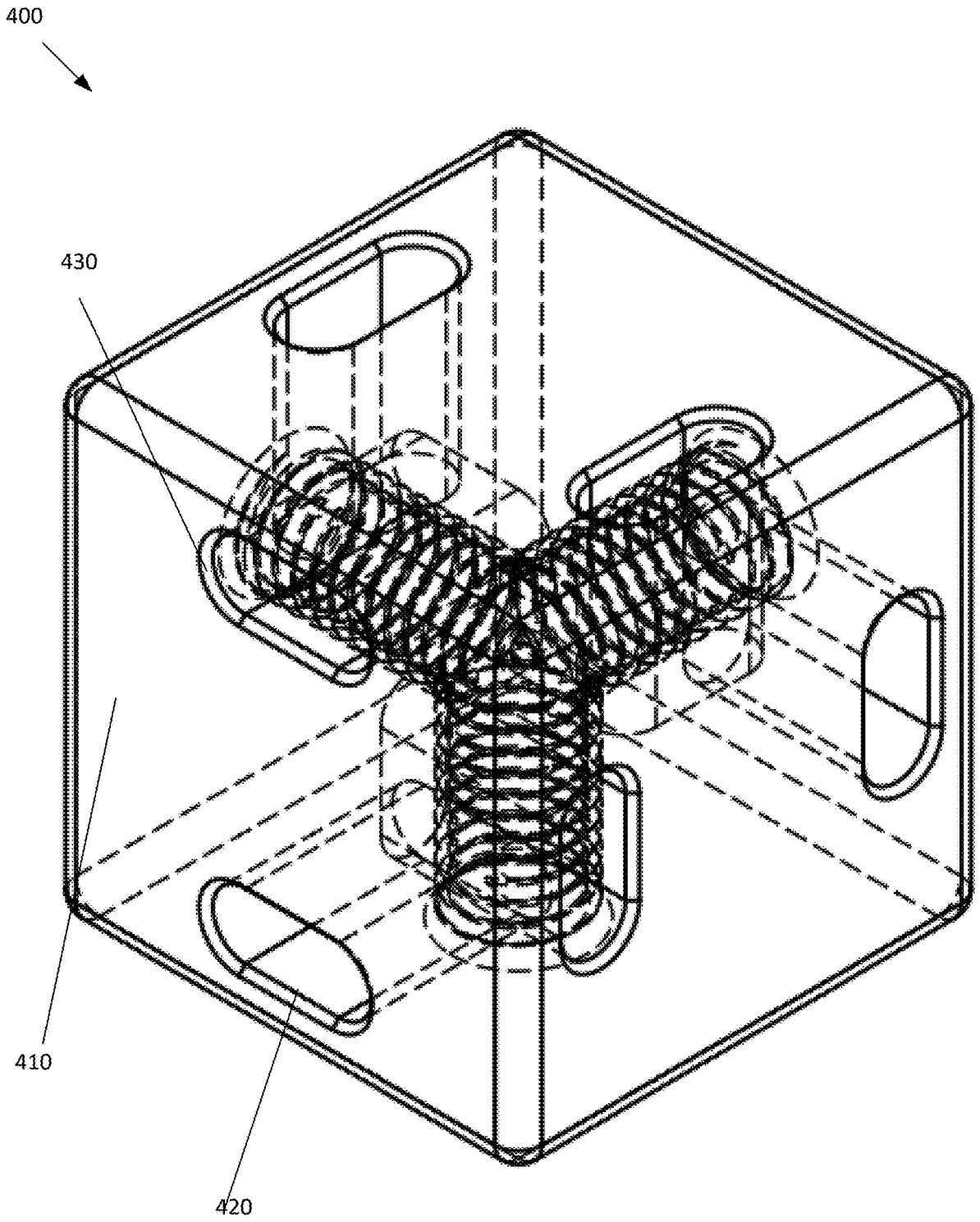
FIG. 4 depicts a perspective view of a base, according to an embodiment.
Figure 5:
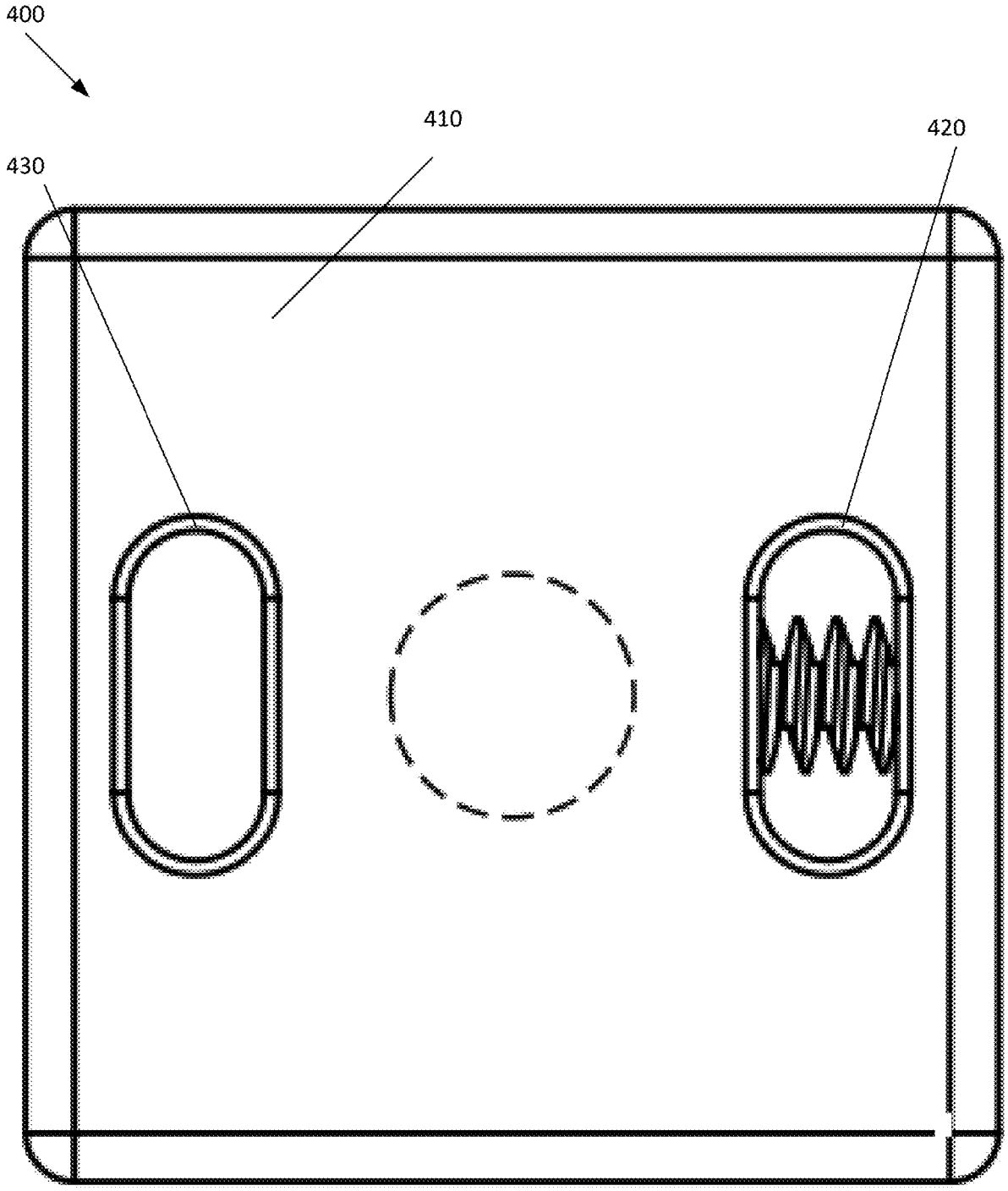
FIG. 5 depicts a side view of a base, according to an embodiment.

FIG. 4 depicts a perspective view of a base 400, according to an embodiment. FIG. 5 depicts a side view of base 400, according to an embodiment. Elements depicted in FIGS. 4 and 5 may be described above, and for the sake of brevity a further description of these items may be omitted.

As depicted in FIGS. 4 and 5, base 400 may include a plurality of faces 410, wherein each face includes a first orifice 420 and second orifice 430. First orifice 420 and second orifice 430 may extend into face 410 of base 400, but may not extend past a midway point of base 400. First orifice 420 and second orifice 430 may be oblong in shape and be configured to receive a proximal end of a flange, wherein the proximal end of the flange may be press fit, friction fit, interference fit, etc. within the oblong orifice. This may couple base 400 and the corresponding flange.

Figure 6:
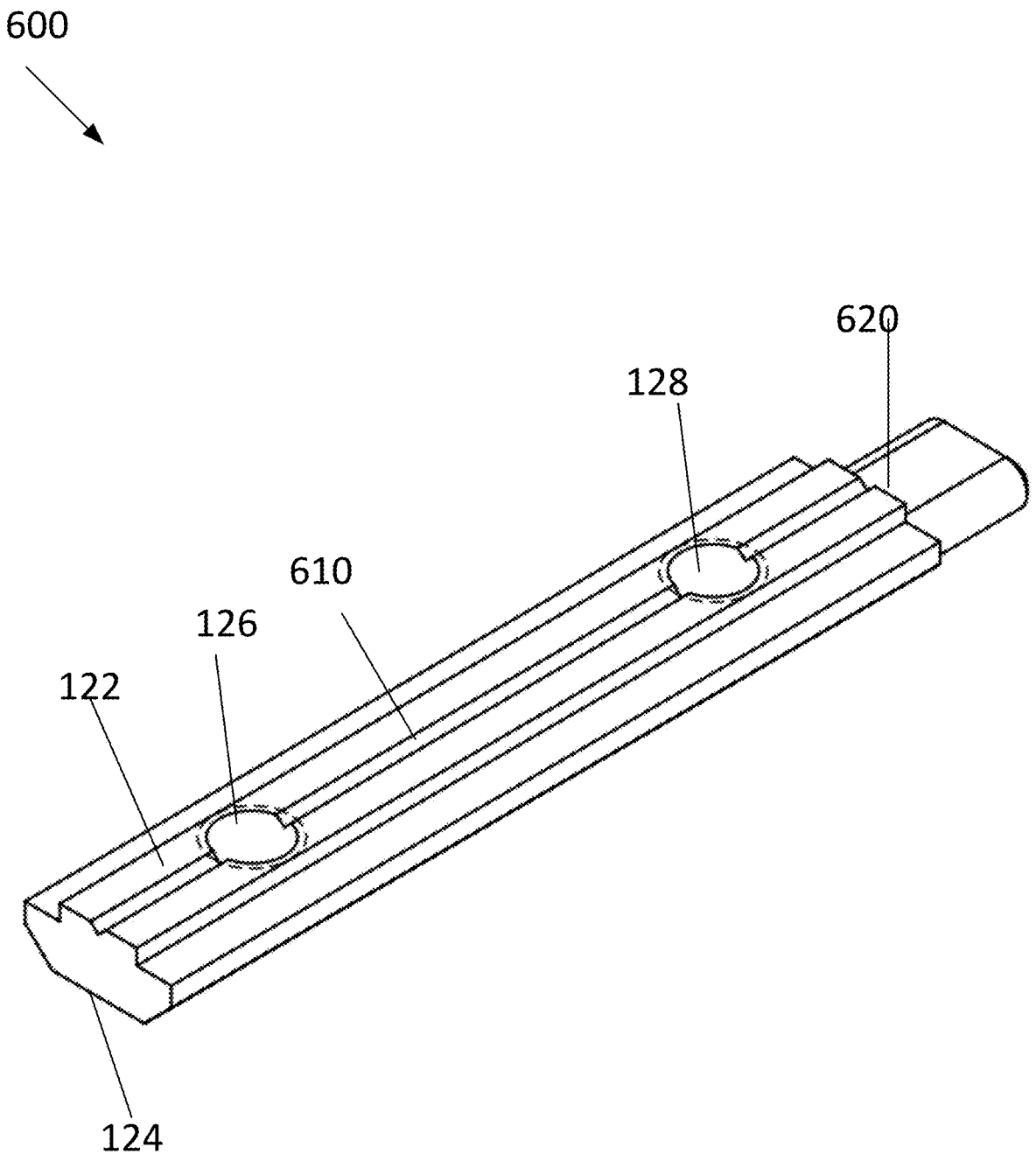
FIG. 6 depicts a perspective view of a flange, according to an embodiment.
Figure 7:
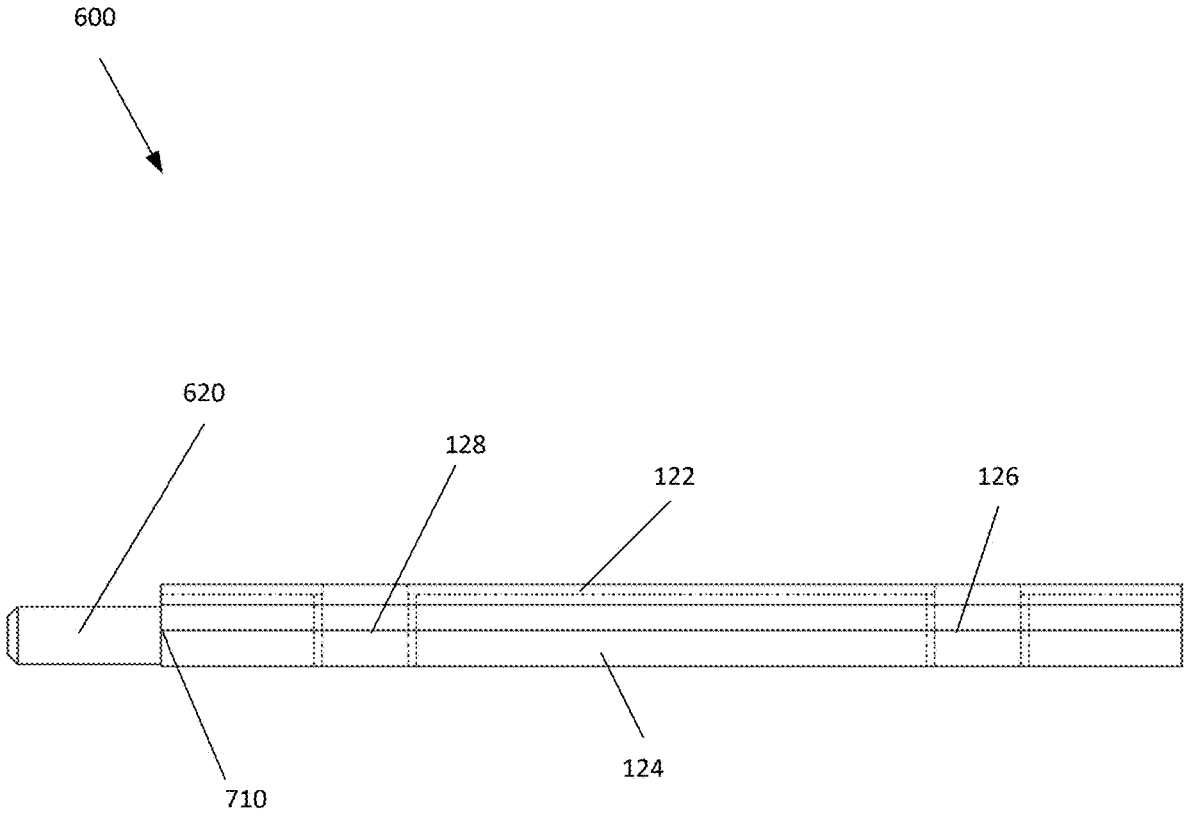
FIG. 7 depicts a side view of a flange, according to an embodiment.
Figure 8:
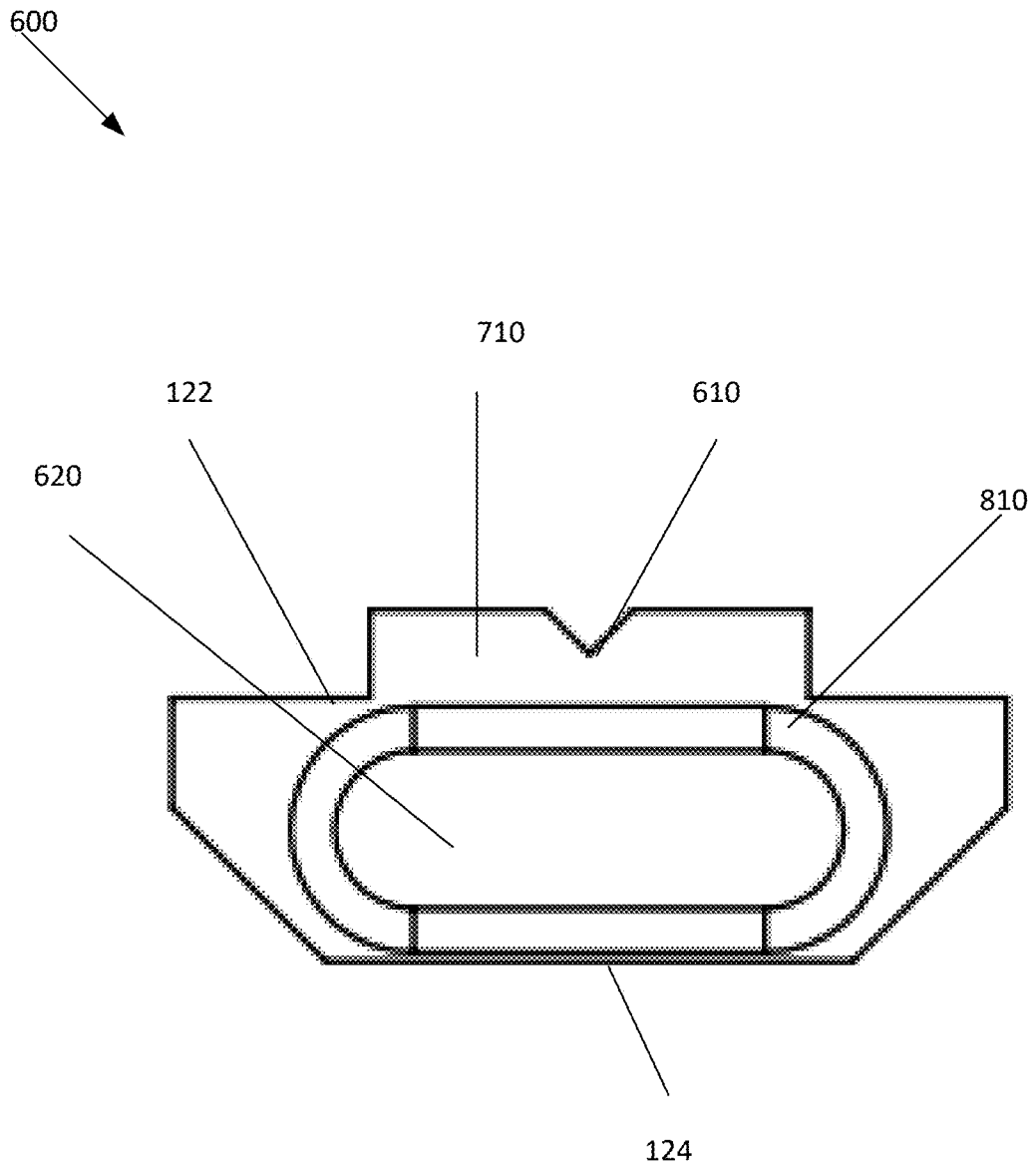
FIG. 8 depicts a front view of a flange, according to an embodiment
Figure 9:
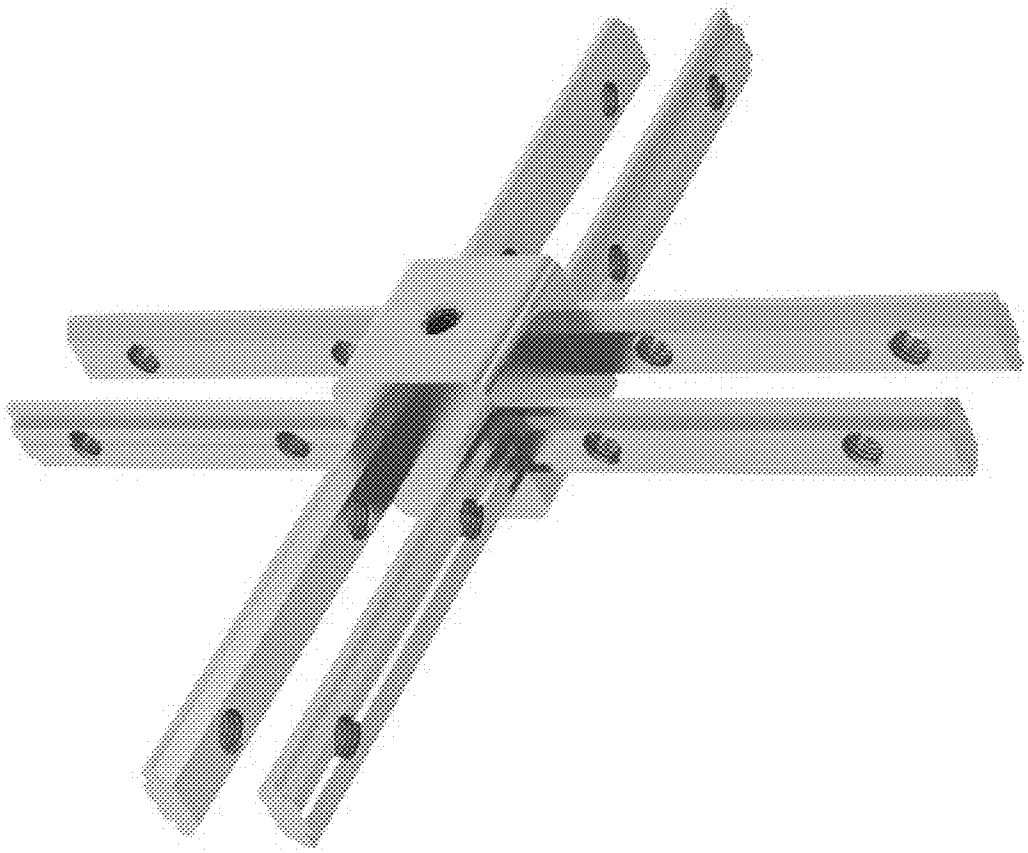
FIGS. 9-19 depict various layouts of connectors formed of a base and pairs of flanges, according to embodiments.
Figure 10:
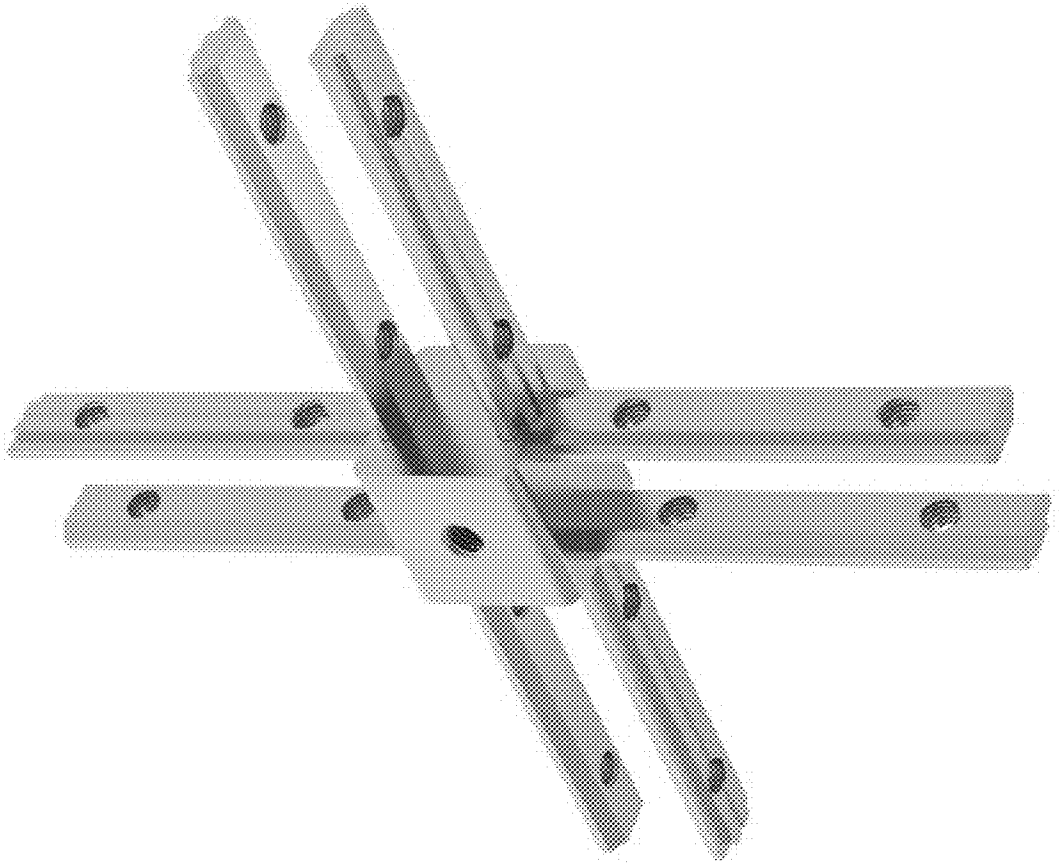
Figure 11:
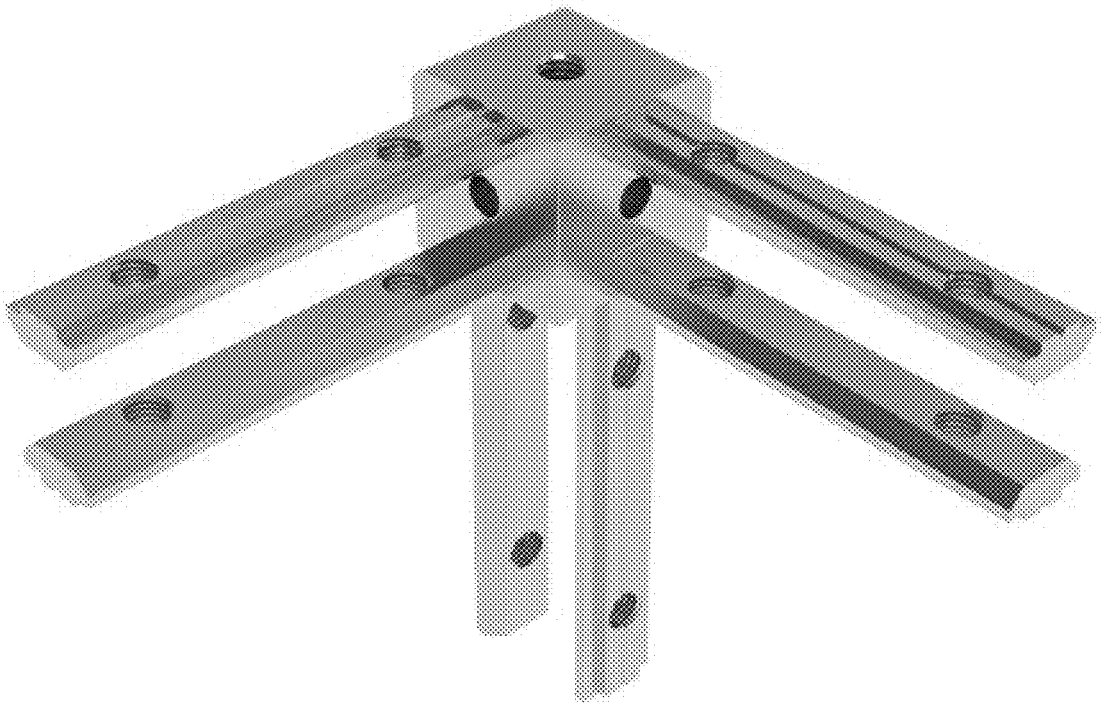
Figure 12:
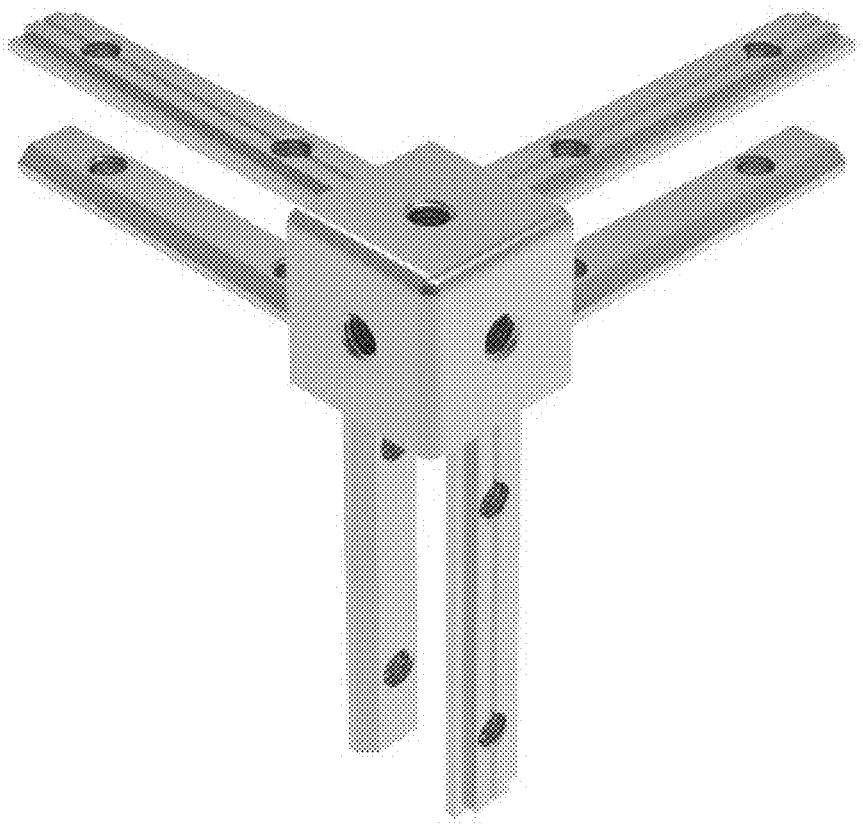
Figure 13:
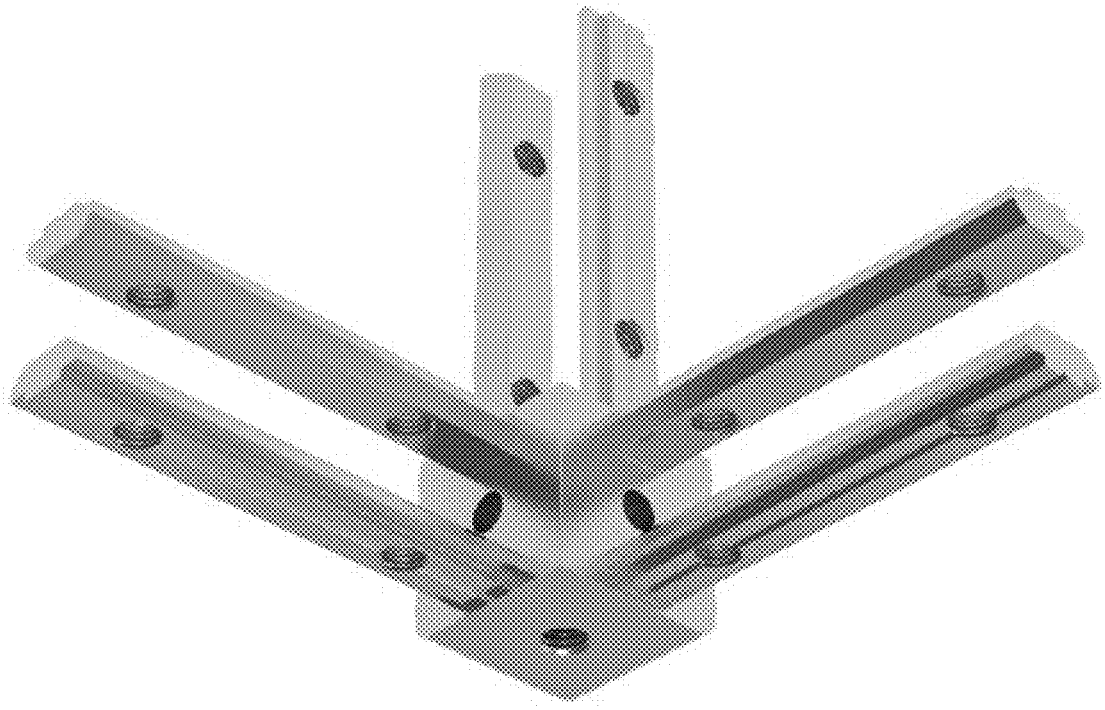
Figure 14:
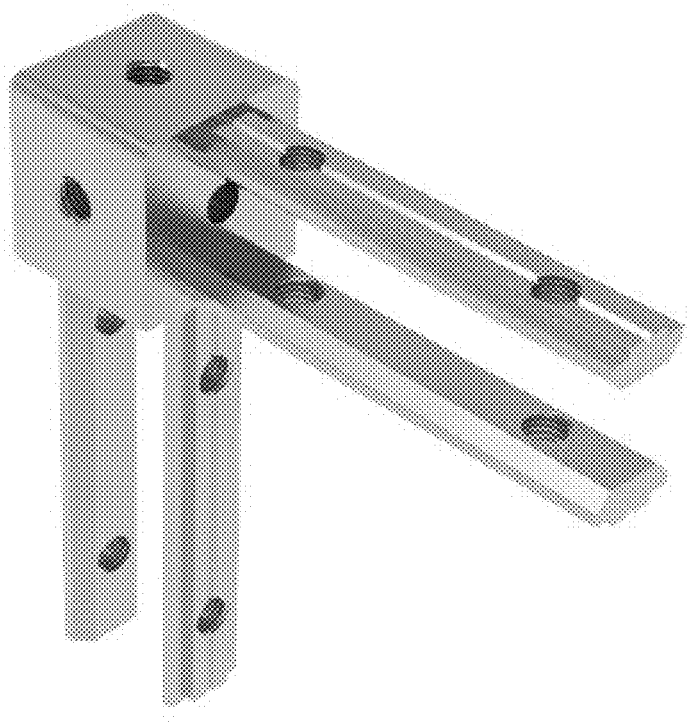
Figure 15:
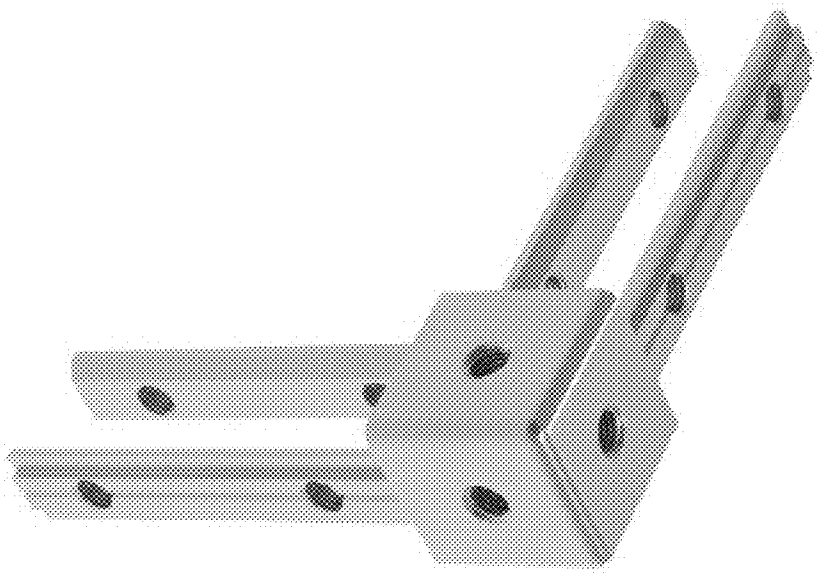
Figure 16:
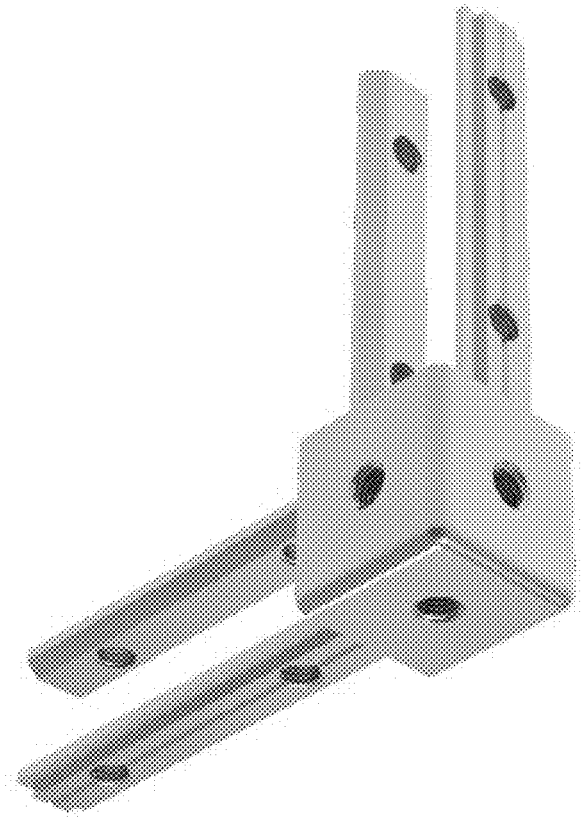
Figure 17:
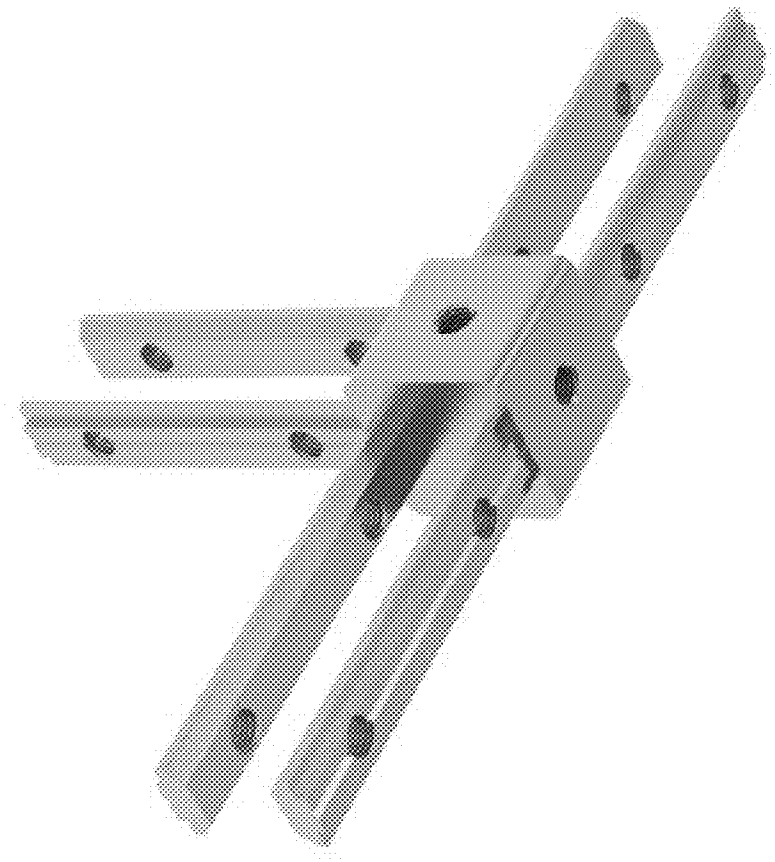
Figure 18:
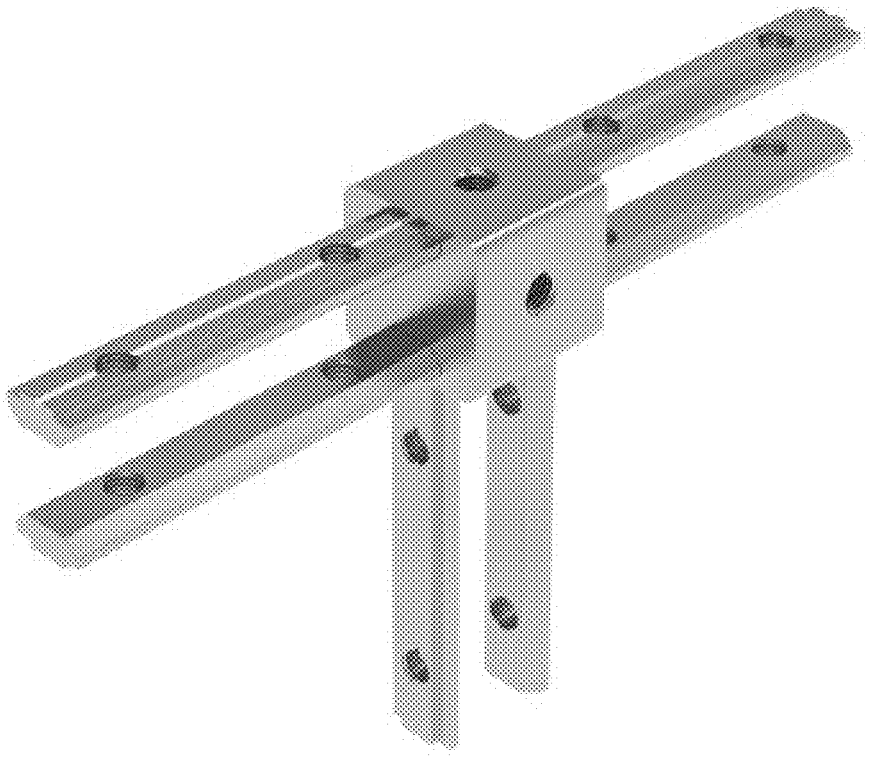
Figure 19:
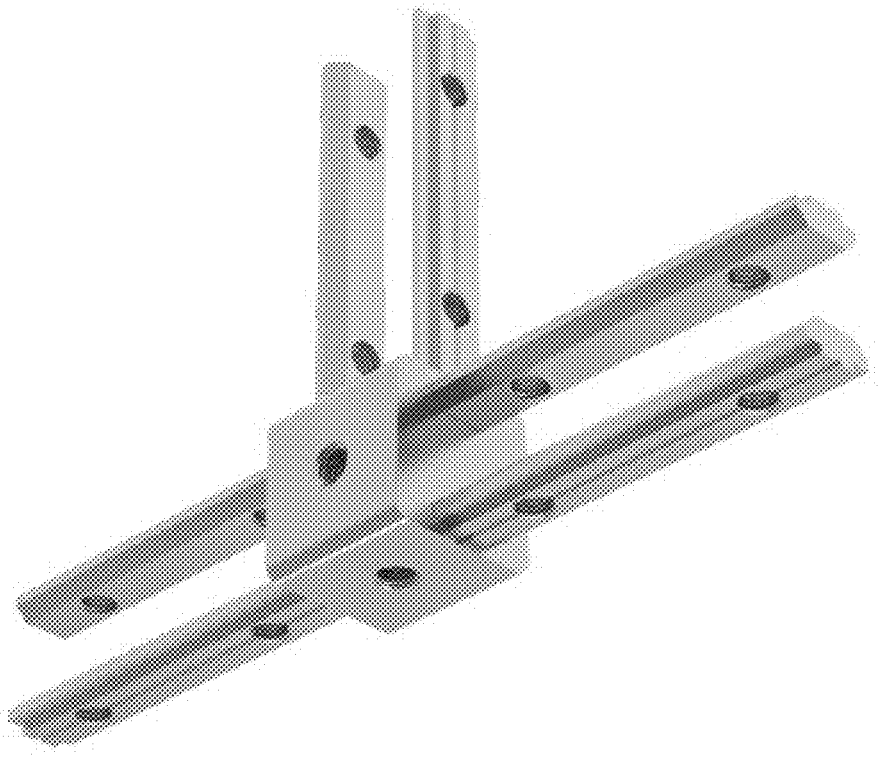

FIG. 6 depicts a perspective view of a flange 600, according to an embodiment. FIG. 7 depicts a side view of flange 600, according to an embodiment. FIG. 8 depicts a front view of flange 600, according to an embodiment. Elements depicted in FIGS. 6-8 may be described above, and for the sake of brevity a further description of these elements may be omitted.

As depicted in the FIGURES, flange 600 may include a v-shaped cutout on the outer profile 610, and an oblong 810 shaped proximal end 620. Proximal end 620 may be configured to be press fit into a corresponding orifice on a face of base 620.

As depicted in FIGS. 7 and 8, proximal end 620 may have shorter height then a height from outer profile 122 to inner profile 124. Proximal end 620 may also have a shorter width than a width across outer profile 122. This may create a face 710, which is configured to be positioned directly adjacent to a face of base 400. A length of proximal end 620 to face 710 may be sufficient to press fit flange 600 within the base.

FIGS. 9-19 depict various layouts of connectors formed of a base and pairs of flanges, according to embodiments. Once skilled in the art may appreciate that these are non-limiting examples, and any number of configurations may be created.

Additionally, any examples or illustrations given herein are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," and "in one embodiment."

References throughout this specification to "one embodiment," "an embodiment" "one example," or "an example" means that a particular feature, structure or characteristic described in connection with the embodiment or example is included in at least one embodiment of the present embodiments. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

As used herein, the terms "comprises," "comprising," "includes," "including," "has," "having," or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

What is claimed is:

1. A connector for a framing system comprising:

a cube with a plurality of faces, the plurality of faces including a first face and a second face, wherein the first face and the second face are positioned in planes that are orthogonal and adjacent to each other;

a first pair of flanges configured to extend away from the first face, the first pair of flanges including a first flange and a second flange, wherein the first flange is symmetrically mirrored with the second flange, a length of the first flange being longer than a width of the first flange;

a second pair of flanges configured to extend away from the second face, wherein the first pair of flanges and the second pair of flanges have orthogonal symmetry about the cube.

2. The connector for the framing system of claim 1, further comprising:

a first pair of orifices extending into the first face, the first pair of orifices being configured to receive proximal ends of the first pair of flanges, the first pair of orifices do not extend past a midway point of the cube.

3. The connector for the framing system of claim 1, wherein the first pair of orifices include a first orifice and a second orifice, the first orifice being offset from edges of the cube, and the second orifice being offset from the edges of the cube.

4. The connector for the framing system of claim 1, wherein the first flange has an outer profile and an inner profile, the offset profile being positioned closer to the second flange than the outer profile, the outer profile including a v-shaped indentation and linear sidewalls.

5. The connector for the framing system of claim 1, wherein the first face of the cube includes a first indentation and a second indentation, the first indentation and the second indentation having a depth that is at most half a width of the second face.

6. The connector for the framing system of claim 5, wherein a first proximal end of the first flange is configured to be inserted into the first indentation, and the length of the first flange is a distance from the proximal end to a first distal end of the first flange, the first proximal end and the first distal ends being positioned on opposite ends of the first flange.

7. The connector for the framing system of claim 6, wherein the first proximal end of the first flange is oblong in shape.

8. The connector for the framing system of claim 7, wherein a width of the oblong is less than a width of the first distal end of the first flange.

9. The connector for the framing system of claim 7, wherein a height of the oblong is less than a height of the first distal end of the first flange.

* * * * *